United States Patent [19]

Robinson

[11] 3,967,667

[45] July 6, 1976

[54] GOLF CLUB COVER-HOLDER CONSTRUCTION

[76] Inventor: Joseph J. Robinson, 1224 E. Front St., Dover, Ohio 44622

[22] Filed: June 23, 1975

[21] Appl. No.: 589,445

[52] U.S. Cl. ..... 150/1.5 R; 150/52 G; 273/32 E

[51] Int. Cl.[2] ..... A63B 55/00

[58] Field of Search ..... 150/1.5 R, 52 G; 273/32 E

[56] References Cited

UNITED STATES PATENTS

| | | | |
|---|---|---|---|
| 2,879,819 | 3/1959 | Turnbull | 150/1.5 R |
| 3,053,298 | 9/1962 | Stamp | 150/1.5 R |
| 3,667,078 | 6/1972 | Distasio | 150/1.5 R |

FOREIGN PATENTS OR APPLICATIONS

| | | | |
|---|---|---|---|
| 26,538 | 1896 | United Kingdom | 150/1.5 R |

*Primary Examiner*—Herbert F. Ross
*Attorney, Agent, or Firm*—Frease & Bishop

[57] ABSTRACT

A golf club cover-holder consisting of four tubular plastic members is adapted to be placed within a golf bag for individually holding and protecting the golf club woods. The tubular members are secured together in a clustered, abutting parallel relationship for receiving golf clubs through open top ends of the tubular members. A longitudinally extending side opening is formed in each of the tubular members and communicates with the open top end and terminates in a lower cutout region formed in the tubular member. The side openings form a pair of flaps in each of the tubular members which extend between the top end and cutout region, which flaps are integral portions of the tubular members. The flaps grip and partially conform to the head of a gold club due to the resiliency and elasticity of the plastic material to retain the club within the tube and to prevent it from contacting adjacent club heads.

8 Claims, 9 Drawing Figures

GOLF CLUB COVER-HOLDER CONSTRUCTION

BACKGROUND OF THE INVENTION

1. Field of the Invention

The invention relates to golf club separating and protecting devices and more particularly to an improved golf club cover-holder construction for individually holding and protecting a set of four golf club "woods". More particularly, the invention relates to a simple, clustered arrangement of four plastic tubular members adapted to be placed within a usual golf bag, the top portions of which automatically grip and partially conform to the golf club heads when the clubs are inserted into the tubular members.

DESCRIPTION OF THE PRIOR ART

Golf club sets consist primarily of a plurality of "irons" and a set of "woods" which are carried in a golf bag by a golfer, which in turn may be mounted on a cart or the like. The heads of the golf club "woods" are generally provided with covers or other protective devices to prevent the heads from being marred and scratched by contacting the adjacent club heads and/or irons during movement of the clubs into and out of the golf bag and during transit throughout the course of play.

The most common type of such protective covers consist of an individual cloth or fabric "mitten" which is placed over each club head, which mittens in turn are attached together by a connecting cord or the like. These individual covers require manual manipulation for removing and placing the same on the club head and are bothersome to the golfer, many times resulting in the covers only being used when the clubs are in storage and not during actual play.

It also is desirable that the shafts of the golf clubs, both woods and irons, be protected at all times from abrasive rubbing and contact with each other and with the sides of the golf bag. This problem has been greatly reduced by the use of a plurality of plastic tubes, one for each golf club, which are placed within the bag for telescopically receiving the tube shafts. These tubes, however, have a tendency to be withdrawn from the bag upon removing the club from the tube due to the sliding friction therebetween, requiring the golfer to manually retain the tube within the bag with one hand, while removing the club from the bag with the other hand.

Various golf club holder and cover constructions have been devised in an attempt to overcome these problems, examples of which are shown in U.S. Pat. Nos. 2,128,546, 2,595,987, 2,879,819, 3,603,368, 3,664,399 and 3,667,078. Many of these constructions have proved satisfactory, but are relatively expensive to the average golfer due to their constructions and configurations. Likewise, many of these constructions require special attachment devices for retaining the holder and cover within the golf bag, and still require special manipulation of the holder and/or cover upon removal and insertion of a club.

It is desirable to achieve the protection afforded the club shafts by the heretofore used individual golf club plastic tubes, while eliminating the need for clips or other retaining means for the tubes, and to provide a covering or protection for the club heads which does not require manipulation upon removal and insertion of a golf club, by a relatively inexpensive and simple golf club cover-holder construction.

No construction of which I am aware has eliminated these problems by providing a plastic tubular member, the top portion of which is provided with integral flaps for retaining and protecting the club head therein, wherein the club is inserted and removed through a top open end as with prior plastic tube separators.

SUMMARY OF THE INVENTION

Objectives of the invention include providing a golf club cover-holder construction which retains the advantages of the plastic tubes to protect and separate the club shafts, and which provides an integral upper portion for retaining the club within the tube and for protecting the faces of the club woods from contacting adjacent club wood faces; providing such a cover-holder construction which can be manufactured rapidly and inexpensively from readily available tubular plastic members, similar to the golf club tubes used by many golfers, without special manufacturing procedures or plastic molding operations being performed thereon; providing such a cover-holder construction for a set of golf club woods which enables a golfer to insert and remove a club from an open top end of a tubular plastic member in a usual manner without manually retaining the tube member within the golf bag and without requiring any manipulation or operation to be performed by the golfer on the head covering and protecting means; providing such a cover-holder construction which can be marked with proper identifying indicia permitting the clubs to be correctly placed within the cover-holder construction; providing such a club cover-holder construction in which the club head covering and holding components are formed integrally with the storage tubes eliminating detachable components which are subject to loss and misplacement; providing such a cover-holder construciton which can be adapted for use with clubs having various length shafts; and providing a golf club cover-holder construciton which is sturdy and durable in use, which is light weight, and which eliminates difficulties heretofore encountered with prior holder constructions, achieves the objectives indicated, and solves problems and satisfies needs existing in the art.

These objects and advantages are obtained by the golf club cover-holder construction, the general nature of which may be stated as including four tubular plastic members, each being adapted to receive a golf club inserted through a top end opening; means securing the tubular members together in a clustered, abutting parallel relationship; each of said tubular members being formed with a longitudinally extending side opening, said side opening facing outwardly from the cluster and oriented approximately 90° with respect to the adjacent tubular members side openings; each of said side openings extending from the top end opening over a relatively short distance with respect to the length of the tubular member and terminating in a cutout region formed in said tubular member; the side opening, open top end and cutout region forming a pair of curved resilient flap means, said flap means extending generally between the top end opening and cutout region on each tubular member and are an integral part of said tubular member; the flap means being biased toward a generally closed position due to the resiliency of the tubular plastic members; and said flap means being adapted to extend along and conform to portions of a golf club head to retain the club within the tubular member and to protect the club head from contacting the adjacent club heads when a golf club is inserted through the top end opening and into the tubular member.

BRIEF DESCRIPTION OF THE DRAWING

A preferred embodiment of the invention - illustrative of the best mode in which applicant has contemplated applying the principles — is set forth in the following description and shown in the drawing and is particularly and distinctly pointed out and set forth in the appended claims.

Similar numerals refer to similar parts throughout the drawings.

DESCRIPTION OF THE PREFERRED EMOBODIMENT

Figure 2:
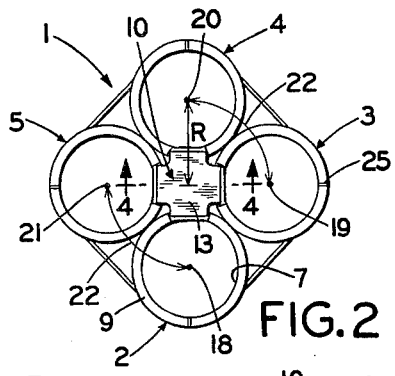
FIG. 2 is a top plan view of the golf club cover-holder construction shown in FIG. 1.

The improved golf club cover-holder construction is generally indicated at 1 (FIGS. 1 and 2) and includes four tubular members 2, 3, 4 and 5, which are secured together in a clustered, abutting parallel relationship. Tubes 2, 3, 4 and 5 are generally similar, thus only tube 2 is shown and described in detail in the drawing and throughout the following description.

Figure 3:
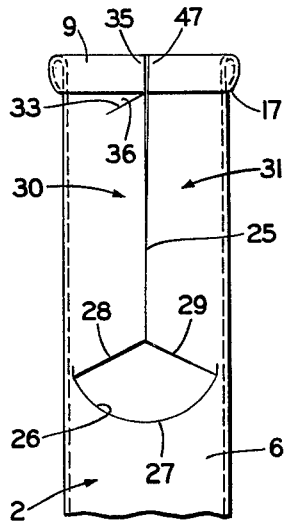
FIG. 3 is an enlarged fragmentary elevational view of the upper portion of one of the tubular members which form the cover-holder construction shown in FIGS. 1 and 2.

The tubes are formed of plastic or other synthetic-type material which has sufficient resiliency and elasticity, as a natural characteristic of the material, enabling the tube to return towards its prestressed condition after a stressing force has been removed. The tubes preferably are of the type produced for and used by many golfers for individual club separators. The tubes each have a hollow cylindrical shape formed by a cylindrical side wall 6 and terminates in top and bottom open ends 7 and 8, respectively. Side wall 6 has an outturned rolled rim 9 which defines top open end 7, and which provides reinforcement for the tops of tubes 2–5 (FIG. 3).

Figure 1:
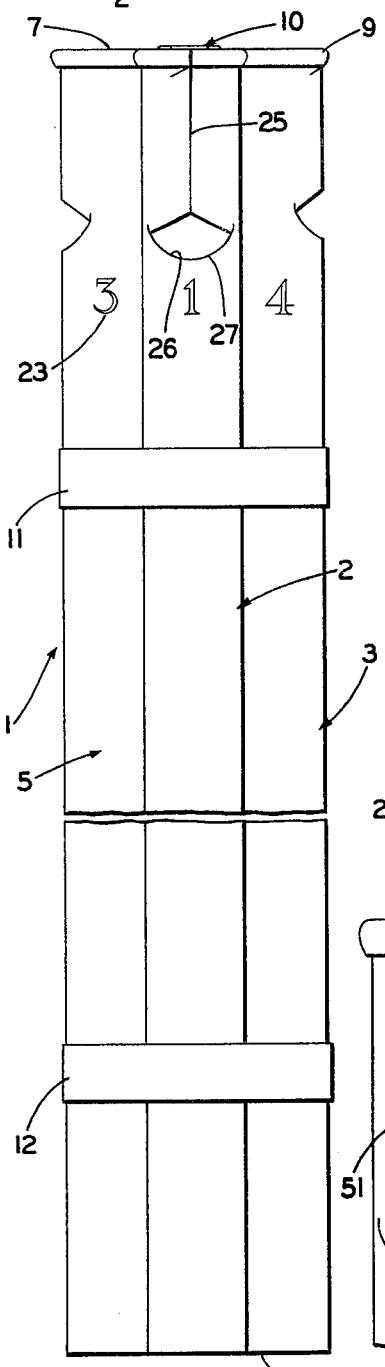
FIG. 1 is a fragmentary elevational view showing the improved golf club cover-holder construction.
Figure 4:
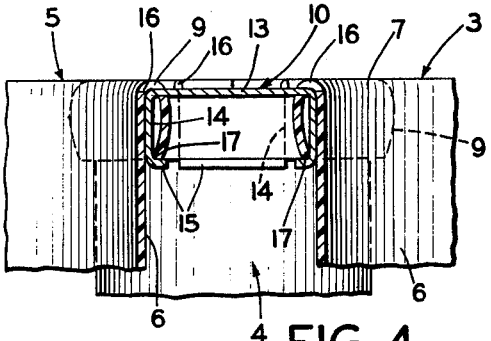
FIG. 4 is an enlarged fragmentary sectional view taken on line 4—4, FIG. 2.

Tubes 2–5 are arranged in the clustered configuration of FIG. 2 by means of top clip 10 (FIG. 4) and a plurality of elastic or tape-like banding straps 11 and 12 (FIG. 1). Clip 10 has a flat, horizontal square base 13 with leg members 14 extending downwardly from the four sides of base 13. Leg members 14 project through openings 16 formed in rims 9 of each of the tubes 2–5, and extend downwardly along the outside surfaces of side walls 6. Leg members 14 terminate in inturned flange 15 (FIG. 4). Clip 10 thus, has no components which are located within the tube interior which could marr and scratch a golf club shaft when inserted and removed from the tube. Inturned flanges 15 of leg members 14 engage bottom terminal edges 17 of rims 9 to secure clip 10 in assembled position. Straps 11 and 12 merely retain the intermediate and lower tube portions together, with the desired spacing and arrangement of tubes 2–5 being provided by clip 10.

The clustered arrangement of tubes 2–5 provide an assembly whereby the longitudinal axes 18, 19, 20 and 21 of tubes 2, 3, 4 and 5, respectively, (FIG. 2) lie on an imaginary circle generated by a radius R extending from the clustered center or center of clip base 13. The centers or axes of tubes 2–5 are oriented 90° from the axes of the adjacent tubes as indicated by arcs 22.

Four such tubes 2–5 are provided for cover-holder construction 1 since most sets of golf club woods are comprised of four clubs, with the particular clustered arrangement of the invention providing the desired club retention and protection as described below. Tubes 2–5 preferably have numbered indicia marked thereon, indicated at 23 (FIG. 1) which corresponds to the club number which is to be stored in the particular marked tube.

In accordance with the invention, a slot 25 is formed in side wall 6 and rim 9 of each tube (FIG. 3) and extends longitudinally downwardly along tube 2 a relatively short distance with respect to the length of the tube. For example, slot 25 has a length of approximately 2 inches, with tubes 2–5 having a length of approximately three and one-half feet. Slot 25 communicates with open top end 7 and terminates in a bottom cutout region 26. Cutout region 26 preferably has a concavely curved or semicircular bottom edge 27 which extends approximately 180° with respect to the circumference of tube wall 6. Cutout 26 is defined further by a pair inwardly upwardly inclined edges 28 and 29 which extend from adjacent the ends of bottom edge 27 and terminate at the bottom of slot 25.

In further accordance with the invention, slot 25 and cutout region 26, together with open top 7 form a pair of flap means, indicated generally at 30 and 31 on each of the tubes 2-5. Flaps 30 and 31 extend generally between open top end 7 and cutout region 26 and are biased toward the closed position of FIGS. 1 and 2 due to the inherent resiliency and elasticity of the plastic material from which the tubes are formed. Flaps 30 and 31 include rim 9 at the top thereof, which rolled configuration increases the tendency of the flaps to return toward their closed positions, which provides strength to the flaps, and which prevents tearing of the flap with respect to the remainder of the tube. Flaps 30 and 31 form the upper portion of each tube 2–5 and extend in a circumferentially extending manner and are integrally connected at the rear portion of the tubes diametrically opposite slots 25, and are integral upper portions of the tubes.

Figure 7:
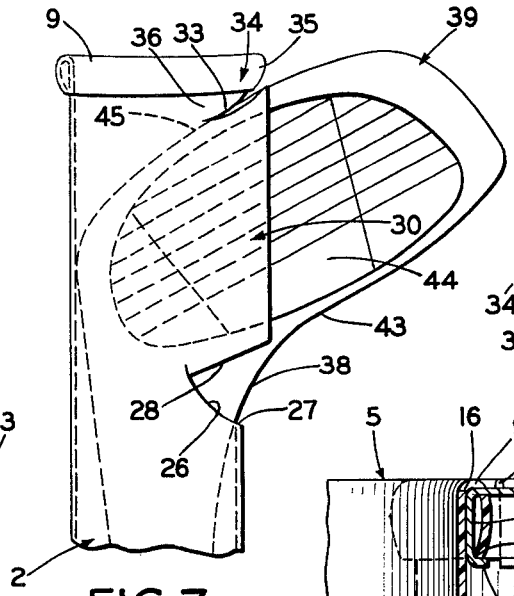
FIG. 7 is a fragmentary side elevational view looking in the direction of Arrows 7—7, FIG. 6.

A secondary slit 33 is formed in flap 30 and extends downwardly inwardly from the top portion of flap 30 adjacent and just beneath rim 9 (FIGS. 3 and 7). Secondary slit 33 forms an auxiliary club top retaining flap 34 on flap 30 which is formed by an end portion 35 of rolled rim 9 and a small section 36 of tube side wall 6. The purpose of secondary slit 33 is set forth below.

Figure 6:
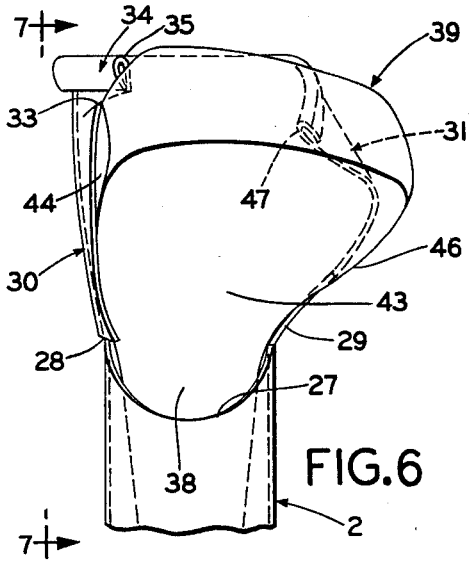
FIG. 6 is an enlarged fragmentary elevational view similar to FIG. 3, with a golf club head being shown retained therein.
Figure 8:
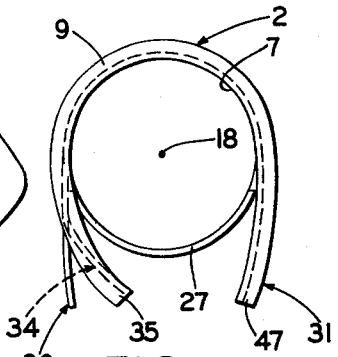
FIG. 8 is a top plan view of one of the tubular members shown in generally open position.

FIG. 8 illustrates flaps 30 and 31 in generally open position without a golf club head being shown therein, prior to the flaps 30 and 31 partially conforming about a club head as shown in FIGS. 6 and 7. Likewise, slots 25 formed by flaps 30 and 31 provide a longitudinally extending side opening in each of the tubes 2–5, which openings are oriented approximately 90° with respect to the adjacent tubular member side openings as shown in FIG. 2

The curvature of bottom edges 27 of cutout regions 26 may be varied slightly in each of the tubes 2–5 depending upon the particular numbered wood club to be retained therein, due to the slight differences in the curvature and shapes of the club necks 38 (FIGS. 6 and 7) to insure better matches with edges 27. Likewise, the lengths of slots 25 will vary slightly, as can be seen in FIG. 1, in each of the tubes 2–5 depending upon the particular club intended to be stored therein because the thicknesses and shapes of the club heads 39 vary for each of the particular numbered woods. These small variations do not effect the concept of the invention, but merely insure and provide a better match between club necks 38 and cutout regions 26.

The operation and manner of use of the improved golf club cover-holder construction 1 is set forth below. The clustered construction is placed within a compartment 40 of a golf bag 41 (FIG. 5) which is defined by a cross brace 42, which compartment 40 is intended for storage of the golf club woods when used without club holder construciton 1. The golf club shaft (not shown) is inserted through the open top end 7 of a selected tube in the ususal manner as is done with conventional plastic golf club tube separators. Flaps 30 and 31 move automatically from their usual closed position of FIG. 3 toward the generally open position of FIG. 8 upon ends 35 and 47 of rim 9 adjacent slot 25 engaging the club head 39 and in particularly engaging the rounded or curved top surface 43 of the club head adjacent neck 38. Flaps 30 and 31 swing easily toward open position due to the flexibility and resiliency of the plastic material permitting the club head to pass easily along and between flaps 30 and 31 to the stored position of FIGS. 6 and 7. The club neck 38 rests against bottom edge 27 of cutout region 26 when in stored position, with the majority portion of flap 30 extending along a portion of the club's ball striking face 44. Retaining flap 34 of flap 30 extends over a portion of the club sole plate 45 to function as a retainer for the club. Flap 31 in an attempt to return to its usual curved state engages and partially conforms about the smaller curved side 46 of club head 39 generally adjacent neck 38 and opposite of striking face 44, with the top portion of flap 31 including the end 47 of rolled rim 9 extending across and in contact with sole plate 45 (FIGS. 5 and 6).

Each club head 39 thus is firmly and securely held against rotation within its respective tube by the clamping-type action of flaps 30 and 31 against striking face 44 and the opposite curved surface 46 of the club head. Likewise, the upper flap portion and rolled rim end 47 of flap 31 and auxiliary flap portion 34 and rim end 35 of flap 30 engage the bottom surface or sole plate 45 of the club head preventing its axial movement from within the tube.

Figure 5:
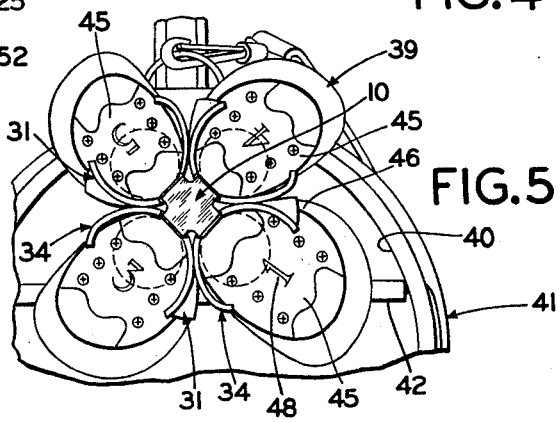
FIG. 5 is a fragmentary top plan view showing the golf club cover-holder construction located within a golf bag and retaining and positioning a set of golf club woods therein.

Each of the four club woods when in stored position assume the configuration and arrangement shown in FIG. 5 in which they are prevented from turning movement within the tubes by flaps 30 and 31 engaging striking face 44 and opposite club surface 46, respectively. Even if the club heads are rotated or twisted within the tube they will not contact the adjacent club head due to the intervening flaps 30 and 31 of the abutting pair of tubes. The clubs, likewise, are prevented from axial movement from the tubes by auxiliary flap 34 and the top portion of flap 31 and rim end 47.

A golfer removes a club easily from its stored position by grasping the exposed club head and pulling axially upwardly on the head. The club head slides easily from its clamped position between flaps 30 and 31 due to the resiliency of the flaps, with the club shaft being withdrawn from the tube in its usual manner. No manipulation or manual contact of any type is required to be performed on the flaps 30 and 31 by a golfer upon placement or removal of a club into and from its respective tube. After removal of a club from its stored position flaps 30 and 31 have sufficient resiliency and elasticity to move toward their closed position. The amount of return and reformation of the plastic flaps and rim portions is dependant upon the particular type of plastic used for forming the tubes and may be affected somewhat by the ambient temperature.

The weight of the three remaining clubs in the cluster prevents cover-holder construction 1 from being pulled inwardly from within the golf bag 41 upon removing a club therefrom eliminating the golfer from manually retaining the tube or tubes within the bag as theretofore required when individual plastic separator tubes are used. The lengths of tubes 2–5 are slightly longer than the club lengths to insure that bottom edge 27 of cutout region 26 engages and supports the club head 39 prior to the opposite shaft end contacting the bottom of the golf bag. The lengths of tubes 2–5 can be shortened easily if desired, by a golfer after purchase of the same when cover-holder construction 1 is to be used for clubs having short shafts, such as those used by women and children. This eliminates the tubes and stored clubs from projecting excessively from the top of the golf bag.

The improved golf club cover-holder construction 1 has a number of advantageous features. The tubes 2–5 can be constructed from the usual type of plastic golf tube separators used by many golfers for individually storing and separating the clubs within the bag, and thus are readily available at an economic cost. The flap means 30 and 31 are formed easily and inexpensively in the top portions of the tubes by simple slitting and cutting procedures eliminating relatively expensive and more difficult manufacturing procedures required for some existing cover-holder constructions. The tubes are assembled into the clustered arrangement easily and rapidly by insertion of clip 10 through rolled rims 9 and installation of banding straps 11 and 12. If desired, cover-holder construction 1 can be packaged and sold in unassembled kit form, with the purchaser completing the assembly thereof, due to the ease and simplicity by which the final construction is completed.

The club cover-holder construction 1 is extremely lightweight, can be produced in various colors to appease the desires of the fashion conscious golfer, and can be adjusted easily for shorter golf club shafts.

Another advantage of the cover-holder construction 1 is that it provides a construction which permits a golfer to insert and remove a club axially from an open top end in a manner in which he is accustomed especially after using the individual plastic tube separators in contrast to known cover-holder constructions requiring the club to be removed laterally (not axially) from its stored position. The golfer is not required to manually retain the tube in the bag with one hand upon withdrawing the club from the tube with the other hand as in many prior devices. Furthermore, the retaining and holding components of cover-holder construction 1 are integral with the tubes and do not require separate detachable components which are subject to loss and misplacement.

Club cover-holder construction 1 permits the club number or indicating indicia 48 (FIG. 5) marked on sole plate 45 to remain entirely visible for quick and easy recognition by a golfer reducing the possibility for an improper club selection during concentrated play. Indicia 23 on the tube side walls 6 insure that the proper club is placed within the proper tube since preferably the lengths of slots 25 and curvature of edges 27 vary for each particular club as described above.

The particular construction and mounting of clip 10 provides a firm connecting means for assembling the tubes in the clustered arrangement whereby the tube side openings face outwardly with respect to the cluster, and oriented 90° with respect to adjacent tube openings. This enables the club storage arrangement of FIG. 5 to be achieved with the symmetrical positioning of the clubs and the desired location of intervening flaps 30 and 31 of adjacent tubes. Likewise, clip 10 is of a simple inexpensive construction which is easily installed, and which eliminates any components thereof extending within the tube or coming into contact with the club head or shaft to prevent possible scratching or marring of a club.

Figure 9:
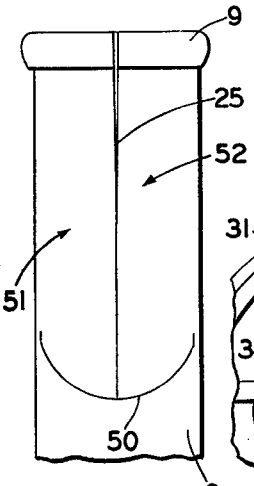
FIG. 9 is an elevational view similar to FIG. 3 showing a modified side opening arrangement in one of the tubular members.

Longitudinal slot 25 can terminate in a single generally transversely extending slit 50 for forming slightly modified flaps 51 and 52 as shown in FIG. 9 without departing from the concept of the invention. Slit 50 preferably has a concavely curved semicircular shape similar to bottom edge 27 of cutout region 26, with slot 25 terminating at the midpoint of slit 50. The additional size of the opening provided by cutout region 26 in contrast to the single slit 50, merely assists flaps 30 and 31 in conforming about a club head and provides better seating for the club neck 38 within the side opening of the tubular member.

If desired, a single "mitten" or fabric cover (not shown) can be used with construction 1 and placed over the four club heads when the clubs are not being used on the golf course, if additional protection is desired for the exposed club head portions.

In the foregoing description, certain terms have been used for brevity, clearness and understanding, but no unnecessary limitations are to be implied therefrom beyond the requirements of the prior art, because such words are used for descriptive purposes herein and are intended to be broadly construed.

Moreover, the description and illustration of the invention is by way of example, and the scope of the invention is not limited to the exact details of the construction shown or described.

Having now described the features, discoveries and principles of the invention, the manner in which the improved golf club cover-holder construction is constructed, assembled, and operated, the characteristics of the new construction, and the advantageous, new and useful results obtained; the new and useful structures, devices, elements, arrangements, parts and combinations are set forth in the appended claims.

I claim:

1. Golf club cover-holder construction including:

a. four tubular plastic members, each formed with a top end opening and being adapted to receive a golf club inserted through said top end opening;

b. means securing the tubular members together in a clustered, abutting parallel relationship;

c. each of the tubular members being formed with a longitudinally extending side opening, said side opening facing outwardly from the cluster and oriented approximately 90° with respect to the adjacent tubular members side openings;

d. each of said side openings extending from the top end opening over a relatively short distance with respect to the length of the tubular member and terminating in generally transversely extending slot means also formed in said tubular member;

e. the side opening, transverse slot means and top end opening forming a pair of curved resilient flap means, said flap means extending generally between the top end opening and transverse slot means on each tubular member, and are formed as an integral part of said tubular member;

f. the flap means being biased toward a closed position due to the resiliency of the tubular plastic members; and g. said flap means being adapted to extend along and conform to portions of a golf club head to retain the club within the tubular member and to protect the club head from contacting adjacent club heads when a golf club is inserted through the top end opening of the tubular member.

2. The construction defined in claim 1 in which the top end of each tubular member is formed with an outturned rolled rim having a terminal edge to provide reinforcement for the top of said tubular member.

3. The construction defined in claim 2 in which clip means is engaged with the rolled rims of the tubular members to secure said tubular members together in the clustered relationship.

4. The construction defined in claim 3 in which the clip means includes a base and four leg members, said leg members terminating in inturned flanges; in which the leg members project through a respective opening formed in each of the tubular member rolled rims; and in which the internal flanges engage the terminal edges of the tubular members to secure the tubular members in the clustered relationship.

5. The construction defined in claim 1 in which a secondary slit is formed in one of the flap means; in which said secondary slit is formed adjacent the open top end of the tubular member and extends generally downwardly away from the longitudinal side opening and communicates with said side opening to form an auxiliary retaining flap which is adapted to extend partially beyond the ball striking surface of a golf club head and adjacent to the bottom club surface when said one flap means is in club retainer position.

6. The construction defined in claim 1 in which the tubular member transverse slot means is a cutout region defined by a generally semicircular bottom edge and a pair of angularly extending edges which extend upwardly inwardly from adjacent the ends of the semicircular edge and terminate at the bottom of the longitudinal side opening.

7. The construction defined in claim 1 in which the longitudinal lengths of the tubular member side openings vary with respect to each other depending upon the particular golf club intended to be received within said particular tubular member.

8. The construction defined in claim 1 in which the tubular member transverse slot means is a generally semicircular concavely curved slit; and in which the longitudinal side opening terminates at the midpoint of said slit.

* * * * *